United States Patent [19]

Ryan

[11] Patent Number: 4,762,203

[45] Date of Patent: Aug. 9, 1988

[54] LIFT TRUCK LOWERING SYSTEM

[75] Inventor: Kenneth E. Ryan, Oxford, N.Y.

[73] Assignee: The Raymond Corporation, Greene, N.Y.

[21] Appl. No.: 66,307

[22] Filed: Jun. 25, 1987

[51] Int. Cl.[4] ..... B66B 9/20

[52] U.S. Cl. ..... 187/9 E; 187/28

[58] Field of Search ..... 187/9 E, 9 R, 28, 20; 414/629, 630; 254/93 R, 93 L, 2 R

[56] References Cited

U.S. PATENT DOCUMENTS 3,394,778 7/1968 Brinton ..... 187/9 E

FOREIGN PATENT DOCUMENTS 0102514 3/1984 United Kingdom ..... 187/9 E

*Primary Examiner*—Michael S. Huppert
*Assistant Examiner*—Kenneth Noland
*Attorney, Agent, or Firm*—Richard G. Stephens

[57] ABSTRACT

A hydraulic relief valve terminates release of fluid to lower a lift truck load carriage if the load carriage becomes supported by external structure during one stage of lowering, and an electrical switch terminates release of fluid, and may disable truck travel, if the load carriage becomes so supported during a different stage of lowering.

7 Claims, 3 Drawing Sheets

LIFT TRUCK LOWERING SYSTEM

In the use of most lift trucks, if the forks of a load carriage become supported by structure external to the truck, such as by a rack shelf, for example, the lift chains may tend to become slack. Such a phenomenon can occur either due to operator error, or if a truck load carriage is left in an elevated position for an appreciable period of time, so that hydraulic leakage allows forks to slowly lower to rest on a rack shelf. If the truck is backed away from the rack with the lift chains slack, the load and load carriage will fall freely far enough to remove the slack in the lift chains. Such falling of the load and load carriage following such "fork hangup" can be very dangerous, causing serious damage or injury.

It long has been well known that the principal problems associated with fork hangup can be alleviated in some types of masts by simple provision of a suitably adjusted low pressure relief valve. The simple use of such a relief valve tends to provide very unsatisfactory operation, however, in a three-stage mast which includes free lift, resulting in unacceptably low lowering speeds during the free lift phase of lowering. Insufficient lowering speed tends to greatly decrease the productivity obtainable with a truck. A primary object of the invention is to provide a three-stage mast system with free lift which prevents an accumulation of appreciable chain slack in the event of fork hangup, but which also provides acceptable lowering speeds.

Another object of the invention is to accomplish the previously stated object using reliable and inexpensive parts.

Other objects of the invention will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which.

Figure 1:
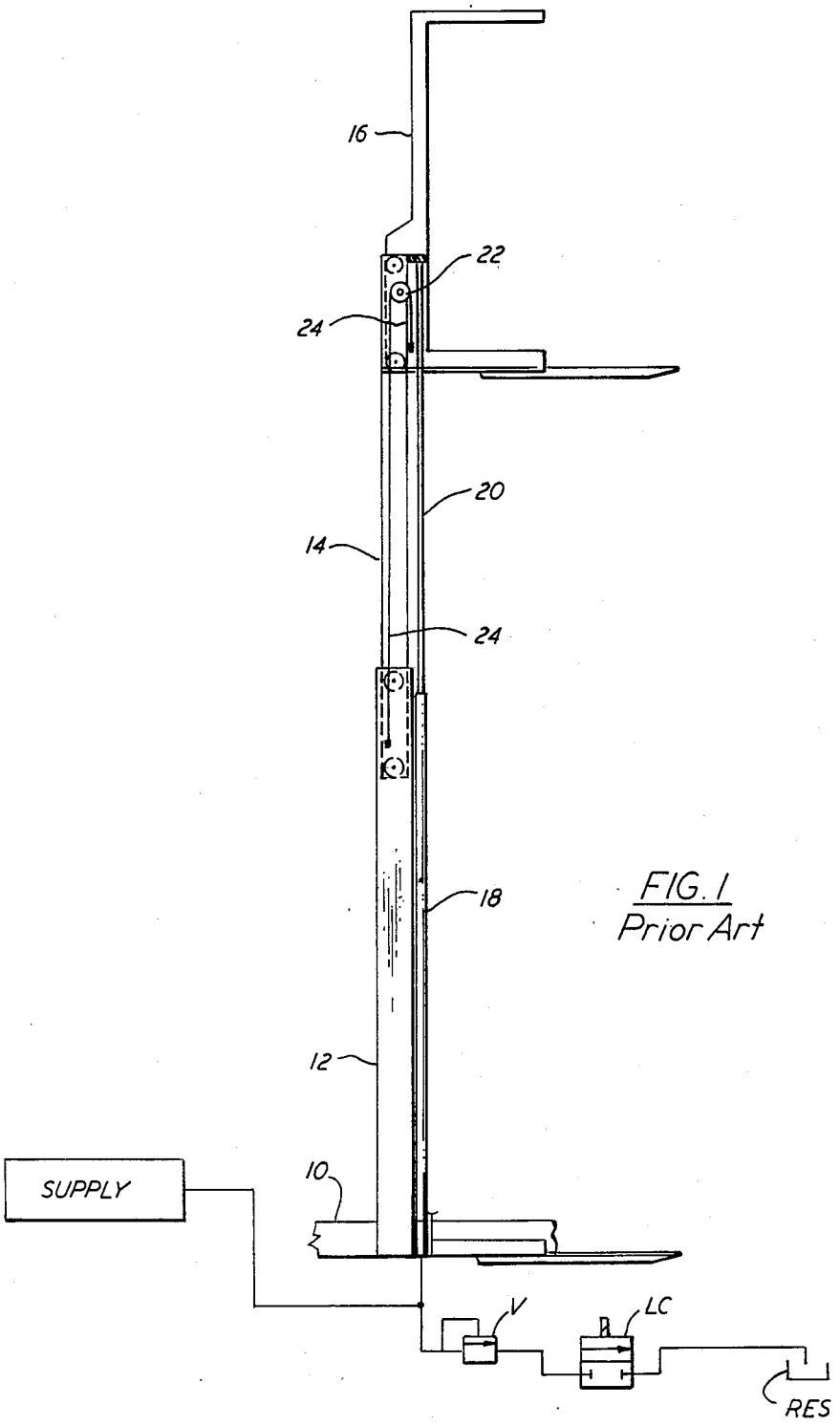
FIG. 1 Prior Art
FIG. 1 is a diagram useful in understanding operation of a prior art two-stage mast.
Figure 2:
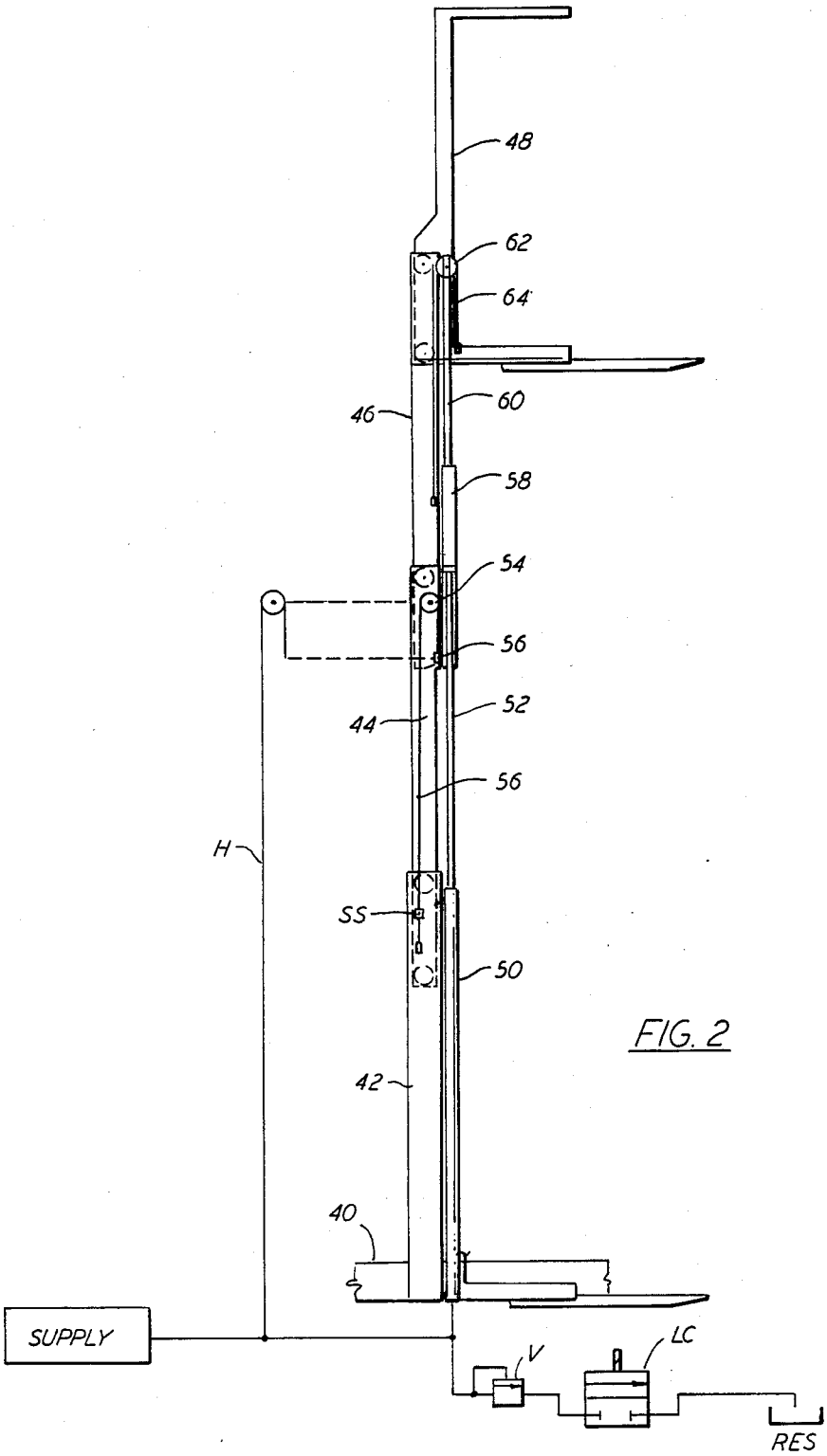
FIG. 2 is a diagram useful in understanding operation of a three-stage mast which utilizes free lift.

While mast sections of usual lift trucks are formed by pairs of laterally spaced apart structural members, such as channels or I-shapes, and pairs of sheaves and chains are used to provide movement of mast sections, the simplified diagrams of FIGS. 1 and 2 refer to single sheaves and chains for simplicity of description.

At the outset it should be understood that FIG. 1 and the description thereof involve only well known prior art principles. FIG. 2 discloses only prior art, except for the addition of a slack chain detector switch assembly.

In the FIG. 1 diagram the base frame 10 of a lift truck carries a stationary mast section 12, which guides vertical movement of a telescopic section 14. The telescopic mast section 14 in turn guides vertical movement of a load carriage 16. A lift cylinder 18 mounted on base frame 10 extends and retracts a ram 20 which is attached to the top of telescopic section 14. A chain sheave 22 is journalled on telescopic section 14 near its upper end. A chain 24 connected at one end to the load carriage is reeved over sheave 22 with its other end attached to stationary structure, such as the fixed mast section. With such an arrangement, the load carriage will be seen to raise and lower at twice the speed at which the ram is extended or retracted, with the load carriage and the telescopic section always moving simultaneously. As previously noted, a pair of laterally spaced sheaves and a pair of chains are actually used in practice. Similarly, what is shown as a single cylinder-ram assembly 18, 20 may in practice comprise a pair of side by side hydraulically interconnected cylinder-ram assemblies.

During normal operation, the force on ram 20 will equal twice the carriage weight (including an payload) plus the weight of telescopic section 14, and that force will provide a pressure P1 in cylinder 18. If the load carriage becomes supported externally, i.e., "hung up", the force on ram 20 becomes solely the weight of telescopic section 14, and that force will provide a lesser pressure P2 in cylinder 18. Assuming an unloaded carriage weight of 1000 pounds and a telescopic section weight of 500 pounds, it will be seen that pressure P1 will equal or exceed 2500k psi during normal operation, and that pressure P2 occurring during hangup will be 500k psi, where k is a conversion factor dependent on cylinder cross-sectional area.

Conventional apparatus which forces hydraulic fluid into cylinder 18 during lifting is indicated by a simple block labelled "supply". A low pressure relief valve V is shown connected to cylinder 18. Lowering is accomplished by bleeding fluid from cylinder 18 via valve V and a lowering control valve LC to a hydraulic fluid reservoir RES. The lowering control valve LC is operated by the truck's operator to control lowering speed, and it may take a variety of known forms. In FIGS. 1 and 2 the symbol for valve LC represents an electrically controlled valve. Relief valve V may be adjusted to open if the pressure in the cylinder exceeds an amount P3, and close if the pressure is less than P3. Pressure P3 must have a value in between P1 and P2. If the pressure at the valve exceeds P3, the valve remains open, allowing lowering to occur, but if the pressure falls below P3, indicating a hangup, the closing of the valve stops lowering, preventing the buildup of appreciable chain slack. The pressure P3 at which the valve V opens and closes cannot be chosen to equal or exceed pressure P1, or else normal lowering of an empty or lightly loaded carriage could not occur, and cannot be chosen to be less than or equal to P2, or else it will always remain open and a slack chain will not be detected.

In a steady-state theoretical sense pressure P3 could be selected to be virtually any value in between P1 and P2. However, in practice the pressure available for normal lowering is not P1, but a lower pressure, due to pressure drops across valve V, and in hydraulic lines and other portions of the hydraulic circuit. In order not to undesirably limit normal lowering speed, it is necessary that the pressure P3 at which valve V switches be arranged to be much closer to P2 than to P1. Otherwise stated, valve V should open in the pressure applied to it barely exceeds the pressure present when the force on ram 20 is due only to the weight of the telescopic section 14. The maximum speed at which lowering can occur depends upon the maximum rate at which fluid can be forced from the lift cylinder, through the relief valve V and through the lowering control valve LC to the fluid reservoir. If the valve setting P3 were very nearly P1, only a very small pressure (P1 minus P3) would be present at the output of valve V to move fluid toward the reservoir, and only very slow lowering could occur, no matter how wide control valve LC is opened by the operator.

In the FIG. 2 diagram the base frame 40 of a lift truck carries a stationary mast section 42 which guides vertical movement of a lower or outer telescopic section 44. The outer telescopic section 44 in turn guides vertical movement of an inner telescopic section 46. The inner telescopic section 46 in turn guides vertical movement of a load carriage 48. A main lift cylinder 50 mounted on base frame 40 extends and retracts a ram 52 which is attached to the top of outer telescopic section 44. A chain sheave 54 is journalled on outer telescopic section 44 near the top thereof. A chain 56 having one of its ends attached to the bottom end of inner telescopic section 46 is reeved over sheave 54, and its other end is attached to stationary structure. With such an arrangement the inner telescopic section will be seen to raise and lower at twice the speed at which ram 52 is extended or retracted.

A free lift cylinder 58 affixed to and carried on inner telescopic section 46 extends and retracts a ram 60. A chain sheave 62 is carried on the upper end of ram 60. One end of a chain 64 connected to load carriage 48 is reeved over sheave 62 and tied to inner telescopic section 46 (or to the free lift cylinder 58 carried thereon). With such an arrangement the load carriage will be seen to be raised and lowered relative to the inner telescopic section 46 at twice the speed at which free lift ram 60 is extended or retracted.

The effective cross-sectional areas of cylinders 50 and 58 are the same, and they are hydraulically interconnected by hose means diagrammatically shown at H in FIG. 2. The use of such a length of hose in order to connect fluid to cylinder 58 tends to cause an appreciable hydraulic circuit pressure drop. As previously noted, what is diagrammatically shown as a single cylinder 50 may comprise a pair of side-by-side cylinders connected in parallel, in which case the sum of the acting areas of the pair is arranged to equal the active area of cylinder 58. Movements of the carriage and telescopic sections occur in two successive stages in the system of FIG. 2. In lifting from a fully lowered condition, the load carriage moves first to the top of the inner telescopic section 46, and then telescopic sections 44 and 46 move up simultaneously, taking load carriage 48 with them. In lowering from the fully extended condition shown in FIG. 2, the telescopic sections 44 and 46 move down simultaneously, taking the carriage with them, and then the carriage alone moves down inside the inner telescopic section 46.

During the first sequence of lifting, or the last sequence of lowering, both telescopic sections are fully retracted, and the load carriage is located at some location along the inner telescopic section 46. This is often called the "free lift stage" or the "first stage". During the free lift stage the force on free lift ram 60 is twice the carriage weight. Call the pressure which that weight causes in cylinder 58 pressure P4. Because cylinders 50 and 58 are hydraulically interconnected, pressure P4 also will exist in cylinder 50. Pressure P4, just adequate to support twice the carriage weight, manifestly is not enough to raise the greater weight of the carriage plus the telescopic sections, and hence the telescopic sections remain retracted during the free lift stage.

As the carriage continues to move upward during the free lift stage, it eventually engages some mechanical stops (not shown) at the top of the inner telescopic section 46. At that instant, which is commonly called "staging", lift supply pressure suddenly increases until it is sufficient to start raising the two telescopic sections. The force on ram 52 is then twice the carriage weight, plus twice the inner telescopic section weight, plus the outer telescopic section weight. Let the pressure developed in the cylinders under these circumstances be called P5. The P5 pressure in free lift cylinder 58 provides more than enough force to hold the load carriage against the stops, with some force left over to exert considerable force against the stops, and hence load carriage 48 stays fixed at the top of inner telescopic section during lifting or lowering above free lift.

The weight of an unloaded carriage is usually about twice that of a telescopic section, so pressure P4, with an unloaded carriage, typically might be 4/7 of pressure P5.

If the load carriage becomes hung up during the last or free lift portion of a lowering sequence, a time when both telescopic sections are fully retracted, no force is being applied to main ram 52, and the only force on free lift ram 60 will be the weight of that ram and chain sheave 62, so the hydraulic pressure in the cylinders falls to a very low value (call it P6).

If, while lowering, the load carriage 48 becomes hung up on a rack during the upper stage above free lift, or first portion of a lowering sequence, the rack will support the inner telescopic section 46 as well as the load carriage, by reason of the engagement between the load carriage and the stops of the telescopic section 46. The force on the main cylinder 50 then becomes merely the weight of the outer telescopic section 44, creating a pressure P2, the same as that described in connection with FIG. 1. Because pressure P2 is much greater than pressure P6, free lift chain 64 will not go slack, but it is also important that main lift chain 56 not go slack.

With carriage hangup able to occur during either of the two diverse conditions described, design of a hangup detection system becomes considerably more complicated. Theoretically, hangup detection could be done using solely one relief valve, as in the prior art. The pressure setting P3 of the relief valve would have to be in between P4 and P6, and also in between P5 and P2. Since P5 is greater than P4, and P2 is greater than P6, this reduces to the requirement that P3 be less than P4 but greater than P2. As mentioned above in connection with FIG. 1, it is necessary as a practical matter that the relief valve setting P3 be made as low as possible, nearly as low as P2, in order to provide acceptable lowering speeds.

Assuming use of a single relief valve as in the prior art, with a valve setting at P3, the pressure available for lowering (i.e., the output pressure from the relief valve) will be:

(a) P5 minus P3 minus hydraulic circuit pressure drops in the case of upper stage lowering, or
(b) P4 minus P3 minus hydraulic circuit pressure drops in the case of free lift lowering.

In the case of the upper stage lowering, P5 is the greatest of the mentioned pressures, and the hydraulic circuit pressure drops are the lowest, so the lowering pressure remains quite high in that stage. The hydraulic circuit pressure drops are low because fluid can be drained from cylinder 50 and returned to the reservoir RES without the fluid having to pass through a long hose. In the case of free lift lowering, P4 typically is roughly half (4/7) of P5. Further, the circuit drops tend to become very substantial owing to the long and generally small-diameter hose H that must be run up and over the mast to supply and drain the free lift cylinder 58. Thus lowering pressure during free lift is greatly reduced, and simple use of the prior art system results in unreasonably slow lowering speed during the free lift stage of lowering.

In accordance with a preferred form of the present invention, the setting P3 of the relief valve is made very low, well below pressure P2, and almost as low as P6, the free lift hangup pressure. With such a low setting of P3, adequate normal lowering speeds are attained during the free lift stage of lowering. However, setting P3 below P2 prevents the valve from detecting hangup during upper stage lowering. To overcome that deficiency, a slack chain detector switch assembly SS is included in chain 56. During upper stage lowering, the tension in chain 56 is equal to the weight of the outer telescopic section 46 plus twice the carriage weight, plus twice the inner telescopic weight. If carriage hangup occurs, that tension reduces to a value equal to the weight of outer telescopic section 44. The decrease of tension in chain 56 causes opening of a microswitch portion of assembly SS. The switch contacts are connected in circuit with the electrically controlled valve LC, so that the opening of the contacts disables valve LC, blocking an fluid flow through the valve, and thereby preventing any accumulation of chain slack.

Figure 3:
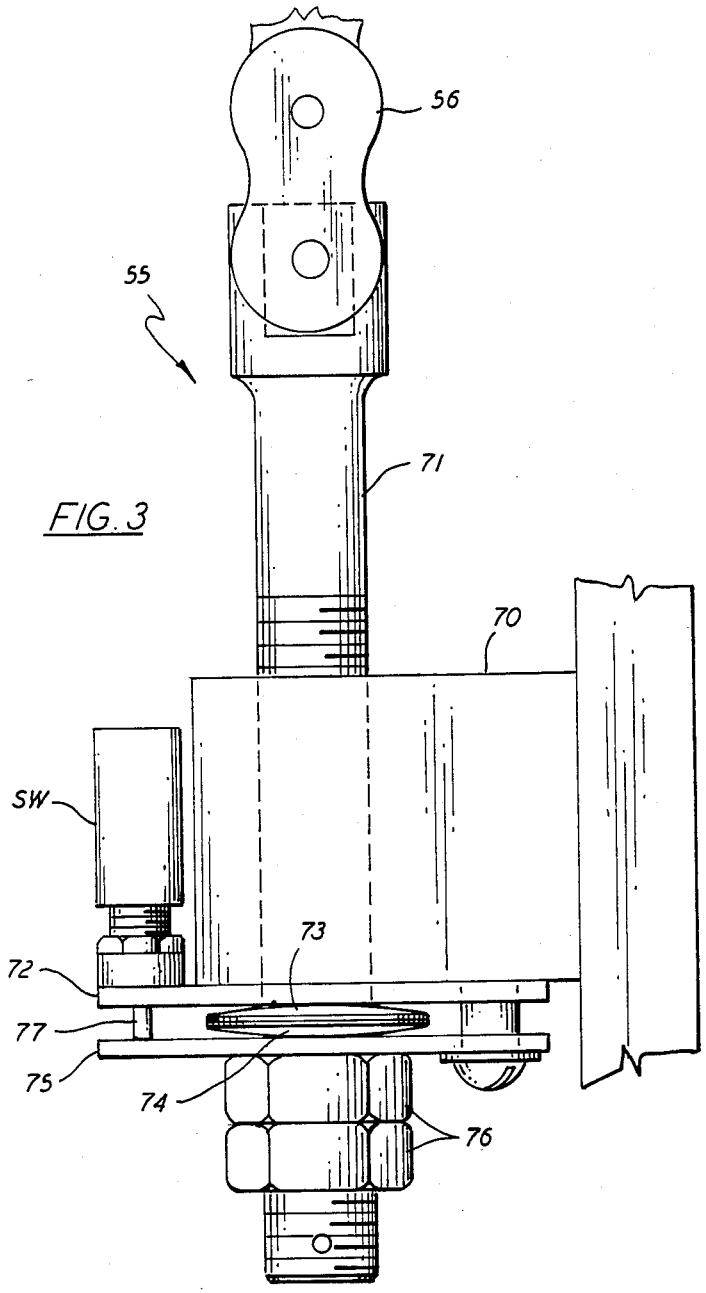
FIG. 3 is an elevation view of one form of slack chain detector assembly according to the invention.

In FIG. 3 the slack chain detector assembly SS is shown including a block 70 which may be welded to a flange of a member of the fixed mast section. Block 70 includes a circular bore through which shaft 71 extends slidingly. Lift chain 56 is connected to the upper end of shaft 71. As previously noted, what is diagrammatically shown as a single chain 56 in FIG. 2 ordinarily will comprise a pair of laterally spaced apart lift chains. The chain slack detector assembly SS ordinarily will be provided in only one of the chains of the pair, although such an assembly could be provided in both chains, if desired. A bracket 72 affixed to block 70 carries an electrical microswitch SW. On the lower end of shaft 71 below block 70 are a pair of mutually opposed "Belleville" washers 73, 74, a ring-shaped bracket 75, and a pair of nuts 76, 76. The Belleville washers act as compression spring means. Bracket 75 engages the plunger 77 of switch SW. The apparatus is shown in FIG. 3 in a "no tension" condition, wherein washers 73, 74 are not compressed, and plunger 77 of switch SW is at an extended position, causing a pair of contacts (not shown) inside switch SW to be open. As increased tension is applied, pulling shaft 71 upwardly against the force of the compression spring means, bracket 75 pushes plunger 77 of the switch increasingly inwardly, eventually operating the switch to close a pair of contacts, and those contacts remain closed, of course, during normal truck operation. If carriage hangup occurs during upper stage lowering, so that the tension in chain 56 drops to a low value, the contacts of switch SS open, disabling lowering control valve LC. After switch SW has opened to disable lowering valve LC, the operator can perform a lifting operation, re-establishing normal tension in the chains, and thereafter normal truck operation may ensue. An arrangement which disables (i.e., closes) the lowering valve when no voltage is applied to it is desirably fail-safe, preventing lowering and further operation of the truck upon failure of switch SW or a wire connection thereto.

To guarantee opening and closing of switch SW, the compression spring means (e.g., washers 73, 74) should, when fully compressed exert a force which is greater than one half the weight of the upper telescopic section, and less than the weight of the carriage plus 1.5 times, the weight of the upper telescopic section, and ideally a force approximately midway between those limits, it being assumed, as in practice, that pairs of chains suspend the carriage and the upper telescopic section.

Figure 4:
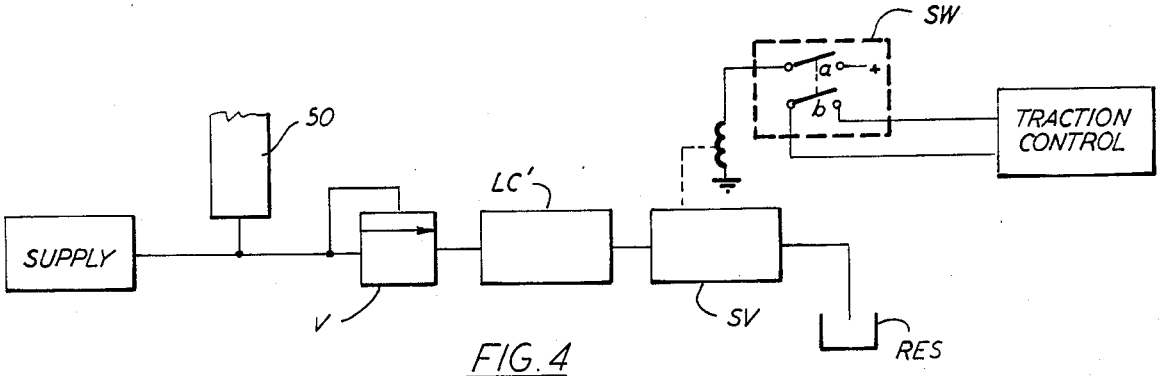
FIG. 4 is a hydraulic-electrical schematic illustrating an alternative form of the invention.

While valve LC controlled by the operator is assumed to be an electrically controlled valve which will block flow if the contacts of switch SW open to disable that valve, the invention is applicable as well to systems wherein the lowering control valve is not electrically controlled. In FIG. 4 the lowering control valve LC' is assumed to be wholly manually controlled. A further solenoid valve SV is included in the circuit, to be held wide open when the slack chain detector assembly contact pair a applies power to valve SV, and to close when a hangup causes contact pair a to open. In FIG. 4 switch SW is shown as including a further contact pair b shown connected to a truck travel control circuit shown as a simple block. When a hangup causes contact pair b to open, the traction motor of the truck is disabled, preventing the truck's operator from backing the truck away from a rack, or whatever other external structure is supporting the load carriage, until after the operator has performed a lift operation to restore normal tension in the lift chains.

As shown above, an electrical switch which senses abnormally low tension in a lift chain may be connected to block fluid removal through the lowering portion of the hydraulic circuit, or it may be connected to disable both lowering and travel of the truck.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. In a lift truck having a base frame, a traction motor system for propelling said truck, a fixed mast section, a first telescopic mast section guided for vertical movement by said fixed mast section, a second telescopic mast section guided for vertical movement by said first telescopic mast section, a load carriage guided for vertical movement by said second telescopic mast section, first cylinder-ram means for raising and lowering said first telescopic mast section relative to said base frame and said fixed mast section, first chain means and first sheave means inter-connecting said first and second telescopic mast sections to provide vertical movement of said second telescopic section relative to said first telescopic section at twice the rate of vertical movement of said first telescopic section relative to said base frame, second cylinder-ram means carried on said second telescopic section, second sheave means connected to be raised and lowered by said second cylinder-ram means, second chain means connected between said load carriage and said second telescopic section and over said second sheave means to provide vertical movement of said load carriage relative to said second telescopic section at twice the rate of extension and retraction of said second cylinder-ram means, said first and second cylinder-ram means being hydraulically interconnected by hose means extending between said second cylinder and said base frame and having substantially the same effective cross-section area, a hydraulic lowering system including an adjustable lowering control valve and a low pressure relief valve connected to bleed fluid from said cylinders when the pressure in said cylinders exceeds a predetermined value, the improvement which comprises chain slack detector means for detecting a reduction in tension below a predetermined amount in said first chain means, as when the load carriage is supported by an external structure during lowering; and means responsive to said slack detector means for disabling at least one of said systems.

2. The truck of claim 1 wherein said means responsive to said slack detector means is operative to disable said hydraulic lowering system.

3. The truck of claim 2 wherein said slack detector means is operative to close said lowering control valve.

4. The truck of claim 2 having a further electrically controlled valve hydraulically connected in series with said lowering control valve and wherein said slack detector means is operative to close said further valve.

5. The truck of claim 1 wherein said means responsive to said slack detector means is operative to disable said traction motor system.

6. The truck of claim 1 wherein said means responsive to said slack detector means is operative to disable both said lowering system and said traction motor system.

7. The truck of claim 1 wherein said first chain means comprises a pair of chains, said slack detector means is connected to detect the tension in one chain of said pair, said predetermined amount is greater than the weight of said second telescopic section, and said predetermined amount is less than 1.5 times the weight of said second telescopic section plus the weight of said load carriage.

* * * * *